US009241520B2

(12) United States Patent
Curl et al.

(10) Patent No.: US 9,241,520 B2
(45) Date of Patent: Jan. 26, 2016

(54) LIGHTWEIGHT AND BREATHABLE GLOVE STRUCTURES

(75) Inventors: Darien Curl, Beaverton, OR (US); Carl L. Madore, Beaverton, OR (US); Marci S. DuChene, Beaverton, OR (US)

(73) Assignee: NIKE, Incorporated, Beaverton, OR (US)

( * ) Notice: Subject to any disclaimer, the term of this patent is extended or adjusted under 35 U.S.C. 154(b) by 806 days.

(21) Appl. No.: 13/450,819

(22) Filed: Apr. 19, 2012

(65) Prior Publication Data

US 2013/0276207 A1 Oct. 24, 2013

(51) Int. Cl.
*A63B 71/14* (2006.01)
*A41D 19/015* (2006.01)

(52) U.S. Cl.
CPC ..... *A41D 19/01582* (2013.01); *A63B 71/141* (2013.01); *A63B 71/146* (2013.01); *A63B 2209/10* (2013.01)

(58) Field of Classification Search
CPC . A41D 19/0006; A63B 71/146; A63B 71/148
See application file for complete search history.

(56) References Cited

U.S. PATENT DOCUMENTS 3,123,832 A * 3/1964 Kubik ..... 2/161.1
3,333,850 A * 8/1967 Miller ..... 473/60
5,598,582 A * 2/1997 Andrews et al. ..... 2/16
5,708,979 A 1/1998 Redwood et al.
37,742 A1* 1/2003 Faulconer ..... 2/161.1
6,543,058 B2 4/2003 Litke
6,625,815 B2 9/2003 Litke
2002/0174478 A1* 11/2002 Litke ..... 2/161.4
2003/0005506 A1 1/2003 Litke
2004/0221365 A1* 11/2004 Fitzgerald ..... 2/159
2009/0144880 A1 6/2009 Desjardin et al.
2010/0077526 A1* 4/2010 Smeltzer ..... 2/16
2011/0088282 A1 4/2011 Dojan et al.
2011/0088285 A1 4/2011 Dojan et al.

FOREIGN PATENT DOCUMENTS

CN 1742641 A 3/2006

OTHER PUBLICATIONS

International Searching Authority, "International Search Report and Written Opinion," issued in connection with international application serial No. PCT/US2013/036352, mailed Jul. 19, 2013, 10 pages.
Chinese Office Action issued on Aug. 25, 2015 in Chinese Application No. 201380032114.8.

* cited by examiner

*Primary Examiner* — Shaun R Hurley
*Assistant Examiner* — Andrew W Sutton
(74) *Attorney, Agent, or Firm* — Banner & Witcoff, Ltd.

(57) ABSTRACT

Gloves, including athletic gloves, may include: (a) a front member, e.g., made from leather; (b) a rear member made from a mesh material (e.g., stretchable mesh) engaged with the front member for covering a back of a hand, wherein the rear member includes at least one support member fused to the mesh material of the rear member, wherein the support member is formed from a material (e.g., a TPU) that is less stretchable than the mesh material to which it is fused; (c) a thumb element engaged at least in part with the front member; (d) a closure system; and/or (e) one or more elastic components extending along a wrist area. The support member(s) may form at least one continuous, unbroken path across the rear member. When multiple support members are present, they may partially overlap. Also, methods for making such gloves are described.

25 Claims, 8 Drawing Sheets

LIGHTWEIGHT AND BREATHABLE GLOVE STRUCTURES

FIELD OF THE INVENTION

The present invention relates to the field of gloves and other hand-receiving devices. In some examples, aspects of the present invention pertain to athletic gloves that are very lightweight and breathable while still providing excellent grip and support, e.g., for use in golf, baseball, softball, football, weightlifting, and other sports and/or for use as work gloves.

BACKGROUND

Sporting events and other activities (such as gardening, yard work, etc.) can take place under a wide range of temperature and humidity conditions. When participating in such athletic activities (golfing, batting, etc.) and/or doing such work (e.g., shoveling, sweeping, digging, etc.), people often wish to wear gloves to protect the hands and/or provide improved grip on the implement they are holding. Gloves for these activities, however, can be very hot as they trap the heat inside and prevent or inhibit evaporation of perspiration from the wearer's skin. This can make the gloves uncomfortable to wear. Failure to wear gloves, however, can compromise grip and/or risk irritating or injuring the skin (e.g., developing blisters, cuts, scrapes, etc.). Accordingly, there is a need in the art for lightweight and breathable gloves, e.g., for use in warm and hot conditions, that provide excellent grip and support while also providing adequate breathability and comfort.

SUMMARY OF THE INVENTION

This Summary is provided to introduce some general concepts relating to this invention in a simplified form that are further described below in the Detailed Description. This Summary is not intended to identify key features or essential features of the invention.

Hand-receiving devices in accordance with some examples of this invention may include: (a) a front member for covering at least a portion of a palm; and (b) a rear member engaged with the front member. This example rear member may include: (a) a rear main body portion located along at least some of a knuckle covering portion of the rear member and made from a mesh material, and (b) a support member fused to the mesh material of the rear main body portion, wherein the support member is formed from a material that is less stretchable than the mesh material of the rear main body portion to which it is fused. The support member may include one or more pieces that form a first portion that extends along the knuckle covering portion of the rear member and a second portion extending from an outside-most knuckle portion toward an area proximate to a side of the rear member opposite the outside-most knuckle portion. Hand-receiving devices according to this invention may include any of the various structures and characteristics described in more detail below.

Glove structures in accordance with at least some examples of this invention may include, for example:

(a) a front member including a palm covering portion and up to four finger front portions extending from the palm covering portion (e.g., wherein the up to four finger front portions include one or more of an index front finger portion, an outside-most front finger portion, and two intermediate front finger portions);

(b) a rear member made from a mesh material (e.g., a stretchable mesh) engaged with the front member for covering a back of a hand, wherein the rear member includes:
   (i) a rear main body portion located opposite the palm covering portion,
   (ii) up to four finger rear portions extending from the rear main body portion (e.g., wherein the up to four finger rear portions include one or more of an index rear finger portion, an outside-most rear finger portion, and two intermediate rear finger portions),
   (iii) a first support member fused to the mesh material of the rear member and optionally extending generally along a knuckle covering portion of the rear member, wherein the first support member is formed from a material (e.g., a thermoplastic polyurethane material) that is less stretchable than the mesh material of the rear member to which it is fused, and
   (iv) a second support member fused to the mesh material of the rear member and optionally extending from a base area of the outside-most rear finger portion to an area proximate to a side of the rear member opposite the outside-most rear finger portion, wherein the second support member is formed from a material (e.g., a thermoplastic polyurethane material) that is less stretchable than the mesh material of the rear member to which it is fused;

(c) a thumb element engaged at least in part with the front member;

(d) a closure system engaged with at least one of the front member and the rear member; and/or (e) one or more elastic components extending along a wrist area of at least one of the front member and the rear member.

At least one of the support members may form at least one continuous, unbroken path from a first side of the rear member to the opposite side of the rear member (e.g., even from edge-to-edge on the rear member). These support members also may partially overlap, e.g., at a junction or at a base area where the rear main body portion meets the outside-most rear finger portion.

Still additional aspects of this invention relate to methods for making gloves and/or components thereof, e.g., of the types described above. Such methods may include one or more of: (a) fusing a first support member, e.g., using heat and pressure, H/F welding, R/F welding, laser welding, etc., to mesh material of a rear main body portion of a rear member of the glove, wherein the first support member is made from a material that is less stretchable than the mesh material of the rear member to which it is fused; (b) fusing a second support member, e.g., using heat and pressure, H/F welding, R/F welding, laser welding etc., to mesh material of the rear main body portion, wherein the second support member is made from a material that is less stretchable than the mesh material of the rear member to which it is fused; (c) engaging the rear member with a front member of the glove; (d) engaging a thumb element at least in part with the front member; (e) engaging a closure system with at least one of the front member and the rear member; and/or (f) engaging one or more elastic components along a wrist area of at least one of the front member and the rear member. While two are mentioned above, any desired number of support members may be fused to the rear member, including one support member, without departing from this invention.

Still additional features and aspects of this invention will be described in more detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

Figure 1A:
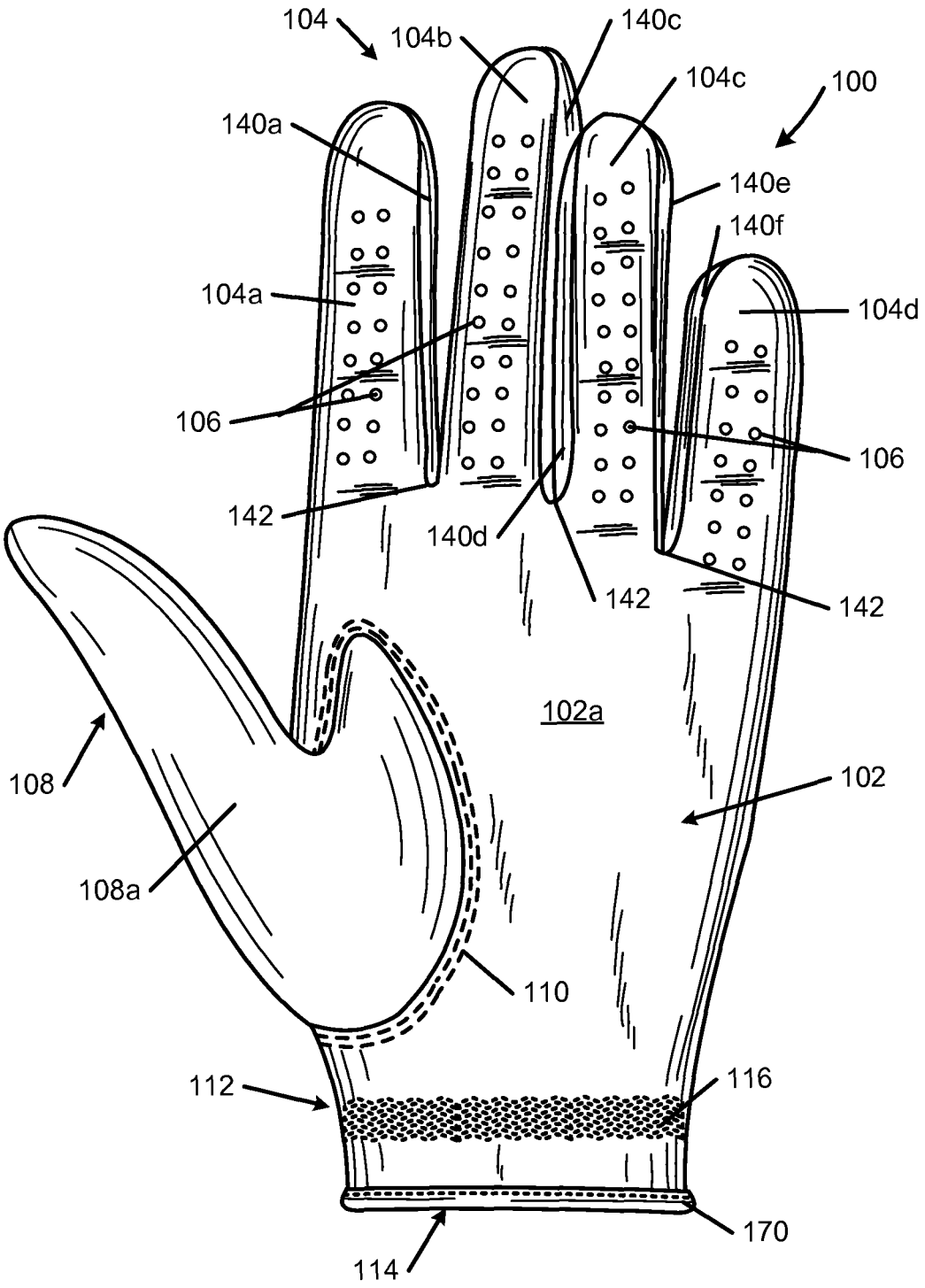
FIGS. 1A through 1D illustrate front, rear, thumb-side (inside), and outside views of one example glove structure in accordance with this invention.

The reader is advised that the attached drawings depict various example features and combinations of features of glove structures in accordance with examples of this invention. These drawings are not necessary drawn to scale.

DETAILED DESCRIPTION OF THE INVENTION

In the following description of various examples of gloves according to the present invention, reference is made to the accompanying drawings, which form a part hereof, and in which are shown by way of illustration various example athletic glove structures in which aspects of the invention may be included. It is to be understood that other glove structures for other uses may be provided and that structural and functional modifications may be made from the specifically described structures and methods without departing from the scope of the present invention.

I. GENERAL DESCRIPTION OF ASPECTS OF THIS INVENTION

Aspects of this invention relate to gloves, and particularly to work or athletic gloves that are very lightweight and flexible while still providing adequate support and structure for their intended use. More specific features and aspects of this invention will be described in detail below.

A. Glove Structures in Accordance with Examples of this Invention

As noted above, some aspects of this invention relate to gloves, such as athletic gloves. Glove structures in accordance with at least some examples of this invention may include, for example, one or more of:

(a) a front member including a palm covering portion and up to four finger front portions extending from the palm covering portion, optionally made of natural or synthetic leather (e.g., wherein the up to four finger front portions include one or more of an index front finger portion, an outside-most front finger portion, and two intermediate front finger portions);

(b) a rear member made from a mesh material (e.g., stretchable mesh) engaged with the front member for covering a back of a hand, wherein the rear member includes:

(i) a rear main body portion located opposite the palm covering portion, (ii) up to four finger rear portions extending from the rear main body portion (e.g., wherein the up to four finger rear portions include one or more of an index rear finger portion, an outside-most rear finger portion, and two intermediate rear finger portions), (iii) a first support member fused to the mesh material of the rear member and optionally extending generally along a knuckle covering portion of the rear member, wherein the first support member is formed from a material (e.g., a thermoplastic polyurethane material) that is less stretchable than the mesh material of the rear member to which it is fused, and (iv) a second support member fused to the mesh material of the rear member and optionally extending from a base area of the outside-most rear finger portion to an area proximate to a side of the rear member opposite the outside-most rear finger portion, wherein the second support member is formed from a material (e.g., a thermoplastic polyurethane material) that is less stretchable than the mesh material of the rear member to which it is fused;

(c) a thumb element (optionally having an inside portion formed from a natural or synthetic leather material and an outside portion formed from mesh material) engaged at least in part with the front member;

(d) a closure system (e.g., a hook-and-loop fastener, a snap fastener, etc.) engaged with at least one of the front member and the rear member; and/or (e) one or more elastic components extending along a wrist area of at least one of the front member and the rear member (e.g., along the wrist opening area through which the hand is inserted into the glove).

At least one of the first and second support members may form at least one continuous, unbroken path from a first side of the rear member (and optionally from a first edge of the rear member) to an opposite second side of the rear member (and optionally to the opposite edge of the rear member). These support members also may partially overlap, e.g., at a junction or at a base area where the rear main body portion meets the outside-most rear finger portion. In some examples of this invention, however, a single support member may be fused to the mesh material of the rear member.

If desired, at least some of the sides of one or more of the finger front portions may be joined with the sides of one or more of the finger rear portions via gusset members. The gusset members may be made from the same material as and may be considered part of the front member. Alternatively, if desired, at least some of these sides may be directly engaged together (e.g., the outsides of the index finger and the little finger).

Glove structures in accordance with at least some examples of this invention will include, as essential components, only front members, rear members, and thumb elements of the types described above engaged together. Glove structures in accordance with other examples of this invention will include, as essential components, only front members, rear members, thumb elements, and closure systems of the types described above engaged together. Glove structures in accordance with still other examples of this invention will include, as essential components, only front members, rear members, thumb elements, and elastic components of the types described above engaged together. As still additional examples, glove structures in accordance with some examples of this invention will include, as essential components, only front members, rear members, thumb elements, closure systems, and elastic components of the types described above engaged together.

B. Methods of Making Glove Structures in Accordance with Examples of this Invention Additional aspects of this invention relate to methods of making gloves and/or various components thereof, e.g., of the various types described above. One more specific aspect of this invention relates to methods for making glove structures that include one or more of: (a) fusing a first support member of the types described above, e.g., using heat and pressure, H/F welding, R/F welding, laser welding, etc., to mesh material of a rear main body portion of a rear member of the glove (of the types described above), wherein the first support member is made from a material that is less stretchable than the mesh material of the rear member to which it is fused; (b) fusing a second support member of the types described above, e.g., using heat and pressure, H/F welding, R/F welding, laser welding, etc., to mesh material of the rear main body portion, wherein the second support member is made from a material that is less stretchable than the mesh material of the rear member to which it is fused; (c) engaging the rear member with a front member of the glove of the types described above; (d) engaging a thumb element of the types described above at least in part with the front member (production of the thumb element optionally may include engaging an inside portion of the thumb element formed from a natural or synthetic leather material with an outside portion of the thumb element formed from mesh material); (e) engaging a closure system with at least one of the front member and the rear member and/or (f) engaging one or more elastic components along a wrist area (e.g., the wrist opening area) of at least one of the front member and the rear member. The various components may have any of the structures, arrangements, and/or orientations described above (and/or any of the structures, arrangements, and/or orientations described in more detail below). While two support members are described above, any desired number of support members may be fused to the rear member, including one, without departing from this invention.

The support members may be engaged with the rear member in a single step, e.g., of applying heat and pressure, by H/F welding, by R/F welding, by laser welding, etc., or these members may be separately engaged with the rear member, e.g., in separate heat and pressure application steps, in separate welding steps, etc. Also, the support members may be engaged with the rear member either before or after the rear member is engaged with the front member. Any desired order of steps is possible without departing from the invention.

Given the general description of features, aspects, structures, processes, and arrangements according to the invention provided above, a more detailed description of specific example gloves and methods of making them in accordance with this invention follows.

II. DETAILED DESCRIPTION OF EXAMPLE GLOVE STRUCTURES ACCORDING TO THIS INVENTION

Referring to the figures and following discussion, various glove structures and features thereof in accordance with the present invention are disclosed. The glove structures depicted and discussed are athletic gloves (and particularly golf gloves), and the concepts disclosed with respect to various aspects of these gloves may be applied to a wide range of athletic glove structures, including, but not limited to: golf gloves, batting gloves, football gloves, weightlifting gloves, and gloves for other sports. In addition, at least some concepts and aspects of the present invention may be applied to a wide range of non-athletic gloves, including gardening gloves, yard work gloves, cleaning gloves, work gloves, and gloves for other activities in which lightweight construction and breathability are desired while not sacrificing grip or protection of the hands. Gloves according to aspects of this invention may include full finger stalls (as illustrated) or partial or no finger stalls (e.g., in which the ends of the wearer's fingers protrude from the gloves). Even further, the concepts disclosed herein may be applied to other hand-receiving devices or structures, for example, partial gloves, protective hand sheaths, manual and remote controllers, hand-receiving devices for use in playing games such as video games, etc. Accordingly, the present invention is not limited to the precise embodiments disclosed herein, but also applies to glove and hand-receiving devices generally. Accordingly, the present invention is not limited to the precise embodiments disclosed herein, but applies to gloves generally.

Figure 1B:
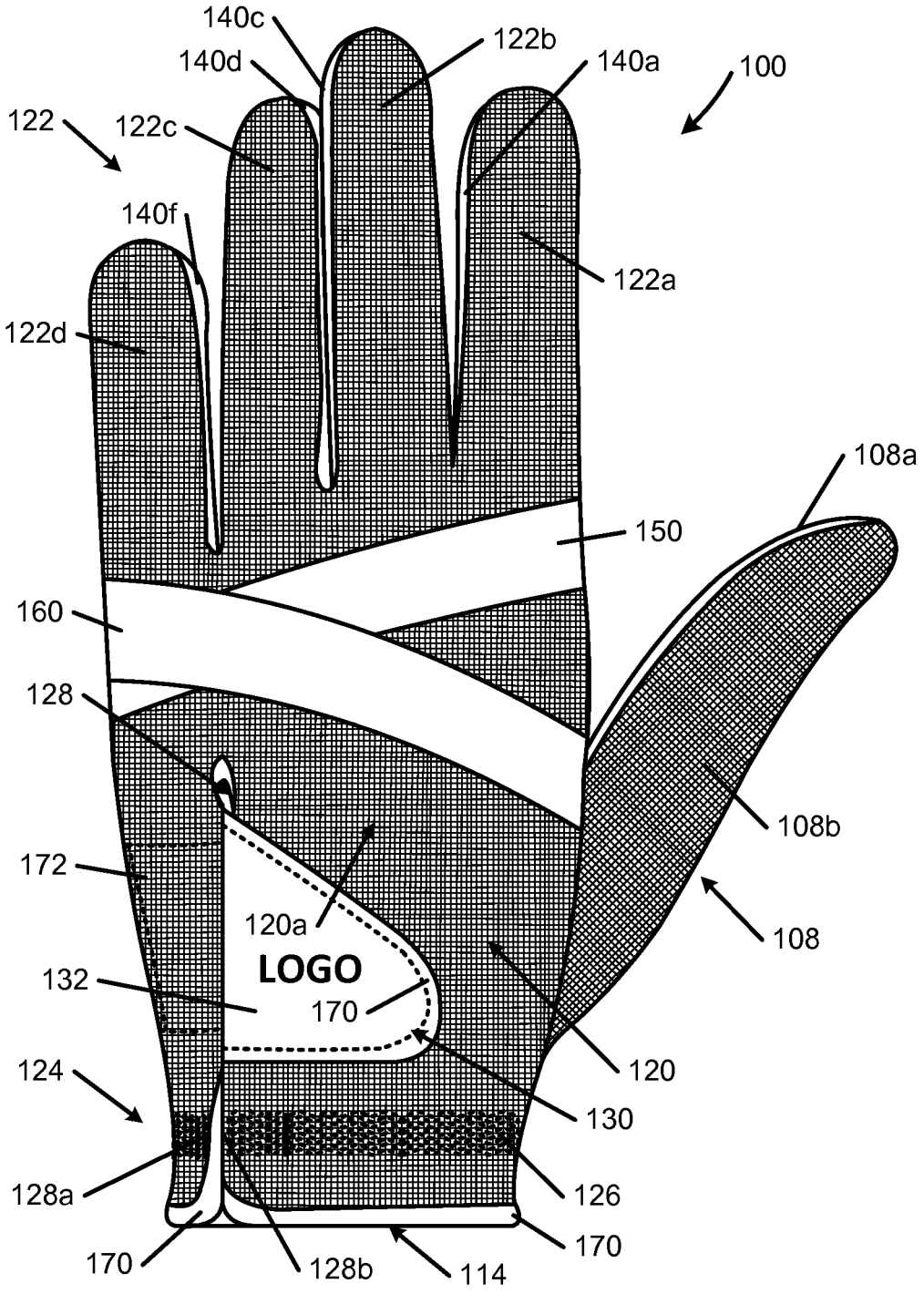
Figure 1C:
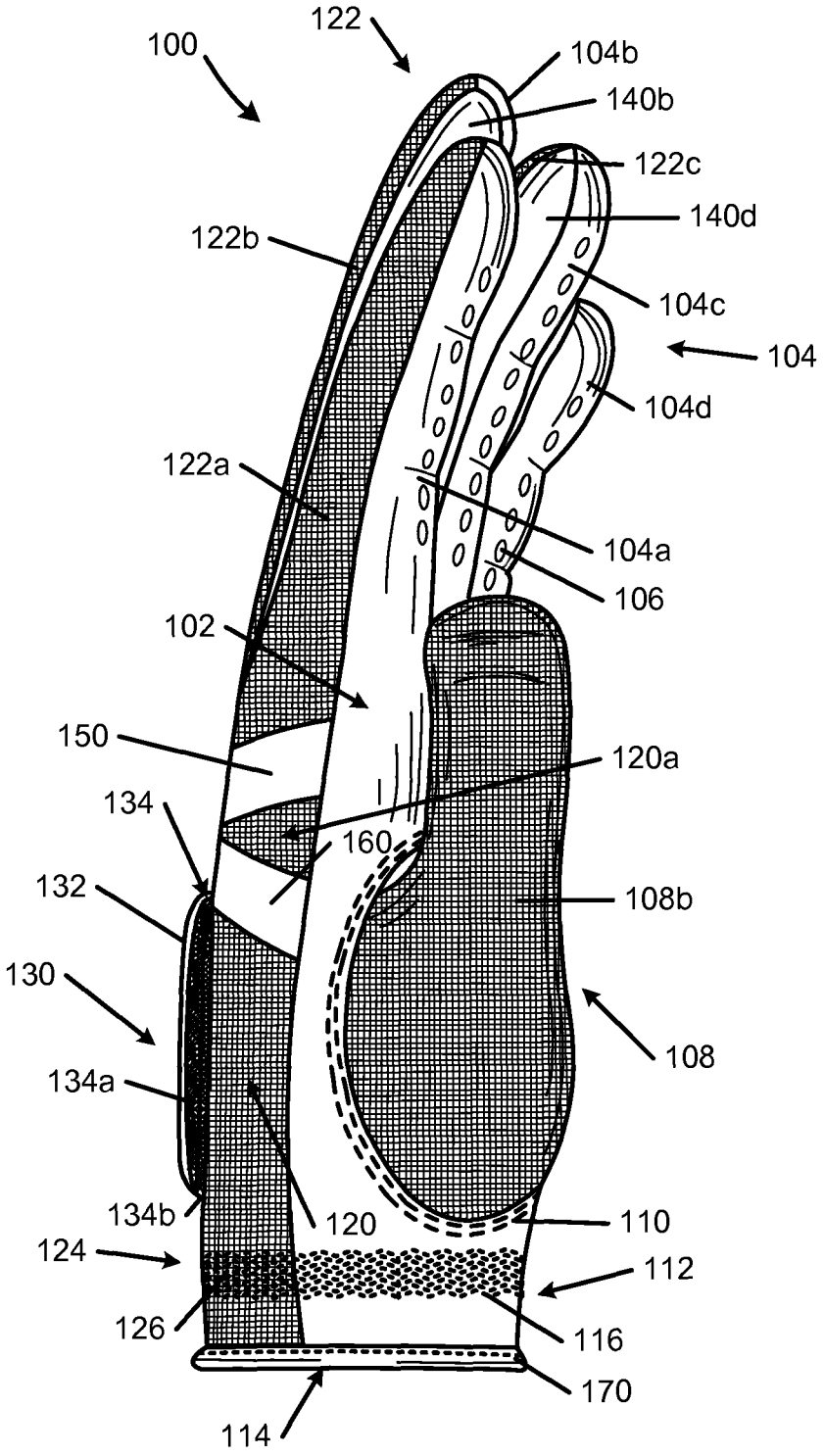
Figure 1D:
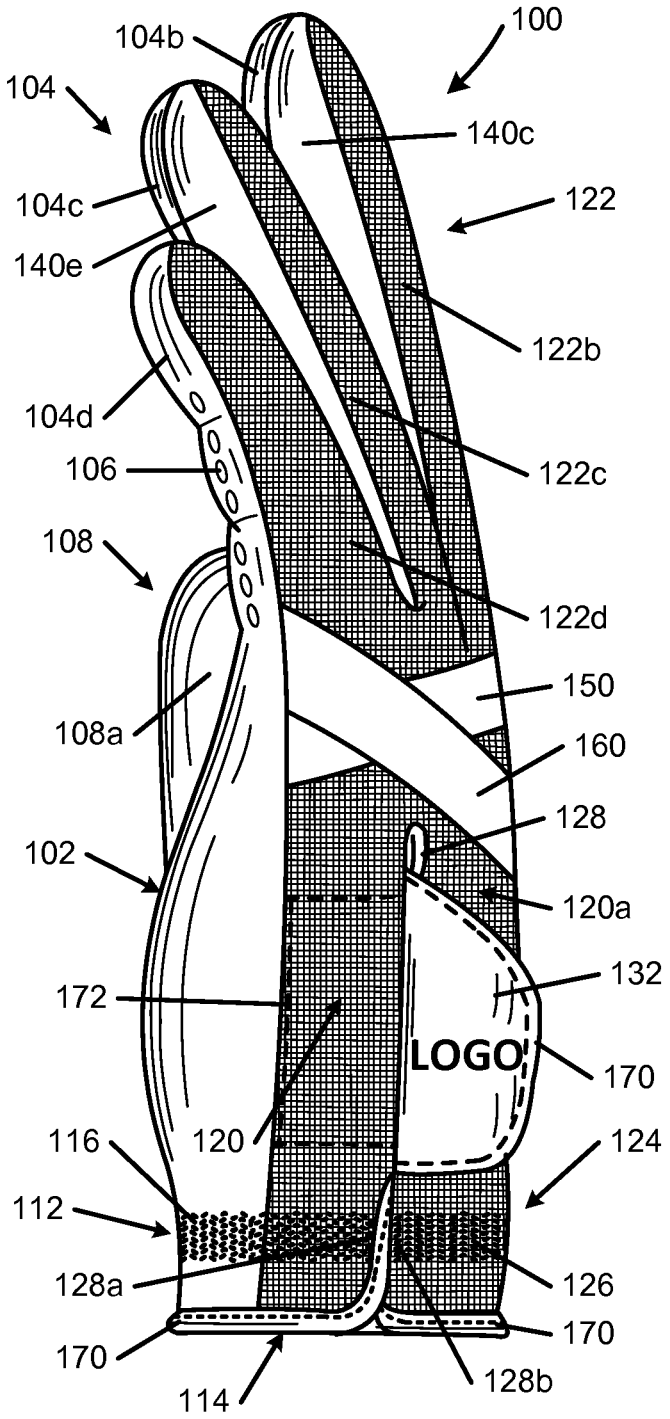

FIGS. 1A through 1D illustrate various views of one example athletic glove structure 100 in accordance with this invention. More specifically, FIG. 1A shows a front view, FIG. 1B shows a rear view, FIG. 1C shows a thumb-side (inside) view, and FIG. 1D shows an outside (pinkie-side) view of the glove 100. As shown in FIG. 1A, the front side of the glove structure 100 includes a front member 102 that includes a palm covering portion 102*a* and four finger front portions 104 extending from the palm covering portion 102*a*, wherein the four finger front portions 104 of this example include an index front finger portion 104*a*, an outside-most front finger portion 104*d*, and two intermediate front finger portions 104*b* and 104*c*. If desired, the finger front portions 104 may include small holes 106 or other openings (e.g., slits etc.) to improve ventilation and breathability. While it may be made of any desired material, in this illustrated example, this front member 102 is formed from a natural leather or synthetic leather material (e.g., cabretta leather, calfskin, etc.) or any other desired material that provides enhanced grip properties. As another alternative, if desired, the natural or synthetic leather materials may be applied to a base fabric layer (e.g., polyester, rayon, cotton, etc.), for example, as patches, at desired locations on the front palm, fingers, and/or thumb.

Also, while it may be made of any desired construction and/or any number of pieces or parts, the front member 102 of this example structure 100, including the palm covering portion 102*a* and the finger front portions 104, constitutes a single piece of leather material, and these portions 102*a* and 104 constitute all or substantially all of the front member 102 of the glove structure 100 (excluding the thumb covering areas). In other words, in this example construction 100, the single piece palm covering portion 102*a* covers substantially all of the wearer's palm (e.g., at least 90% of the palm surface area) and each front finger portion 104*a* through 104*d* covers all or substantially all of the fronts of the wearer's fingers (e.g., at least 90% of the front finger surface area).

FIG. 1A further shows that the glove 100 includes a thumb element 108 engaged at least in part with the front member 102, e.g., along stitching line 110 shown in FIG. 1A. While it also may be made of any desired material, in this illustrated example, at least the front portion 108*a* (shown in FIG. 1A) of the thumb element 108 is formed from a natural leather or synthetic leather material (e.g., cabretta leather, calfskin, etc.). Also, while it may be made of any desired construction, the front portion 108*a* of thumb member 108 in this illustrated example constitutes a single piece of leather material. Optionally, if desired, some portion of the thumb element 108 may be engaged with a rear member of the glove structure, although this illustrated construction shows the thumb element 108 engaged only with the front member 102.

FIG. 1A further shows that a wrist area 112 of the front member 102 of this example glove structure 100 (near the opening 114 for receiving the wearer's hand) includes an elastic component 116 to provide a secure and snug fit to the wearer. Any number of elastic elements may be incorporated into the elastic component 116 without departing from this invention.

FIG. 1B shows a rear member 120 of this example glove structure 100. The rear member 120 is engaged directly or indirectly with the front member 102 and covers a back of a wearer's hand. In this illustrated example, the rear member 120 includes a rear main body portion 120*a* located opposite the palm covering portion 102*a* and four finger rear portions 122 extending from the rear main body portion 120*a* and located opposite the four finger front portions 104. An interior chamber for receiving the wearer's hand is defined between the front member 102 and the rear member 120. The four finger rear portions 122 include an index rear finger portion 122*a*, an outside-most rear finger portion 122*d*, and two intermediate rear finger portions 122*b* and 122*c*. The rear main body portion 120*a* and the four finger rear portions 122 are made from mesh material. The mesh material provides a very lightweight and breathable rear portion to the glove structure 100. In some examples, the openings in the mesh material may be of sufficient size to enable the wearer's hand to be visible through the material.

While it may be made of any desired construction and/or any number of pieces or parts, the rear member 120 of this example glove structure 100, including the rear main body portion 120*a* and the finger rear portions 122, constitutes a single piece of mesh material, and these portions 120*a* and 122 constitute all or substantially all of the rear member 120 of the glove structure 100. In other words, in this example glove construction 100, the single rear main body portion 120*a* covers substantially all of the back of the wearer's hand (e.g., at least 90% of the rear hand surface excluding the fingers) and each rear finger portion 122*a* through 122*d* covers all or substantially all of the rear of the wearer's fingers (e.g., at least 90% of the rear finger surface area).

If desired, the thumb element 108 can be made from a single piece or type of material, e.g., like the leather materials described above in conjunction with FIG. 1A. Alternatively, as shown in FIGS. 1B and 1C, however, in this illustrated example, the thumb element 108 includes a rear portion 108*b* made from mesh material, e.g., the same as or similar to the mesh material making up the majority (or all) of rear member 120. While it may be made of any desired construction, the rear portion 108*b* of thumb member 108 in this illustrated example constitutes a single piece of mesh material engaged with the front portion 108*a* of the thumb element 108 in some manner, e.g., via adhesives, via stitching or sewing, etc. Optionally, if desired, at least some portion of the thumb element 108 (e.g., some of the rear portion 108*b*) may be engaged with the rear member 120 of the glove structure 100 (although, in this illustrated example, the entire thumb element 108 is engaged with the front member 102).

FIG. 1B further shows that a wrist area 124 of the rear member 120 of this example glove structure 100 (near the opening 114 for receiving the wearer's hand) includes an elastic component 126 to provide a secure and snug fit to the wearer. Any number of elastic elements may be incorporated into the elastic component 126 without departing from this invention. While elastic components 116 and 126 may constitute two or more separate pieces (optionally spaced apart in some manner), if desired, elastic components 116 and 126 may constitute a single band or strap of elastic material that extends continuously from one side 128*a* of the glove opening slit 128 to the other side 128*b*. As another option, a single elastic strap or band may extend from the outside junction of the front and rear members at the first side (outside) of the glove 100, along the front member 102, around the thumb side, along the rear member 120, to the edge 128*b*, and a second elastic strap or band may extend the short distance from the outside junction side of the glove 100 to the edge 128*a*.

As noted above, the glove structure 100 of this example includes a glove opening slit 128 that increases the glove opening size to allow easy insertion and removal of a wearer's hand. The glove opening slit 128 is closed off by a closure system 130, which may be engaged with at least one of the front member 102 and the rear member 120. While any desired type of closure system 130 may be provided without departing from this invention, in this illustrated example, the closure system 130 includes a flap 132 engaged with at least one of the front member 102 and the rear member 120, and the flap 132 includes a first portion 134*a* of a hook-and-loop fastener 134. A second portion 134*b* of the hook-and-loop fastener 134 of this example construction is engaged with the rear member 120. As shown in FIG. 1B, an elastic band 172 may extend from (a) the outside seam where the front member 102 and the rear member 120 meet to (b) the flap 132, so that the flap 132 can be pulled around the wearer's hand to tighten the glove's fit.

If desired, the front member 102 and the rear member 120 may be directly coupled to one another, e.g., by stitching or sewing or other techniques, for example, down the sides of the glove 100. This connection, however, may be indirect in some examples of this invention, at least in some areas of the glove structure 100. For example, at least some of the finger front portions 104*a* through 104*d* may be engaged with at least some of the finger rear portions 122*a* through 122*d* at their side edges, e.g., by gusset members. FIGS. 1A through 1D show that in this illustrated example structure 100, the finger portions 104 and 122 are connected together as follows:

(a) an outside of the index front finger portion 104*a* is directly engaged with an outside of the index rear finger portion 122*a*, e.g., at a sewn seam (see FIG. 1C);

(b) an inside of the index front finger portion 104*a* is engaged with an inside of the index rear finger portion 122*a* via a first gusset member 140*a*, e.g., at sewn seams (see FIGS. 1A and 1B);

(c) a first side of the first intermediate front finger portion 104*b* is engaged with a first side of the first intermediate rear finger portion 122*b* by a second gusset member 140*b*, e.g., at sewn seams (see FIG. 1C);

(d) a second side of the first intermediate front finger portion 104*b* is engaged with a second side of the first intermediate rear finger portion 104*b* by a third gusset member 140*c*, e.g., at sewn seams (see FIGS. 1A, 1B, and 1D);

(e) a first side of the second intermediate front finger portion 104*c* is engaged with a first side of the second intermediate rear finger portion 122*c* by a fourth gusset member 140*d*, e.g., at sewn seams (see FIGS. 1A through 1C);

(f) a second side of the second intermediate front finger portion 104*c* is engaged with a second side of the second intermediate rear finger portion 122*c* by a fifth gusset member 140*e*, e.g., at sewn seams (see FIGS. 1A and 1D);

(g) an inside of the outside-most front finger portion 104*d* is engaged with an inside of the outside-most rear finger portion 122*d* by a sixth gusset member 140*f*, e.g., at sewn seams (see FIGS. 1A and 1B); and (h) an outside of the outside-most front finger portion 104*d* is directly engaged with an outside of the outside-most rear finger portion 122*d*, e.g., at a sewn seam (see FIG. 1D).

Gusset members of this type, for purposes of this specification and description, may be considered as an optional part of the front member 102 (and may be made from the same materials as front member 102). If desired, the first gusset member 140*a* and the second gusset member 140*b* may be formed as a unitary, one piece construction; the third gusset member 140*c* and the fourth gusset member 140*d* may be formed as a unitary, one piece construction; and/or the fifth gusset 140*e* member and the sixth gusset member 140*f* may be formed as another unitary, one piece construction (e.g., such that a single piece of gusset material extends through the valley areas 142 between finger portions). Additionally or alternatively, if desired, the second gusset member 140*b* and the third gusset member 140*c* may be formed as a unitary, one piece construction; and/or the fourth gusset member 140*d* and the fifth gusset member 140*e* may be formed as a unitary, one piece construction (e.g., such that a single piece of gusset material extends over the fingertip areas). As another example, if desired, all of the gusset members 140*a* through 140*f* may be formed as a unitary, one piece construction.

One or more of the valley areas 142 between adjacent fingers of the glove 100 may include an opening, e.g., to further improve the glove's fit, flexibility, and breathability, if desired.

The glove structure 100 of this illustrated example further includes two support members 150 and 160 that extend along the rear member 120 to provide additional support and a more secure fit for the wearer. As shown in FIGS. 1B through 1D, a first support member 150 is engaged with the mesh material of the rear member 120 and extends generally along a knuckle covering portion of the rear member 120. A second support member 160 is engaged with the mesh material of the rear member 120 and extends from a base area of the outside-most rear finger portion 122*d* (e.g., where the outside-most rear finger portion 122*d* meets the rear body portion 120*a*) to the opposite side of the rear member 120. The first and second support members 150, 160 may be "fuse bonded" to the mesh material of the rear member 120 along at least a portion of their lengths. The term "fuse bonded" or "fused," as used herein, means that the parts are bonded to one another by applying heat and pressure, by exposing to high frequency radiation and pressure, by exposing to radio frequency waves and pressure, by exposing to laser radiation and pressure, etc., and without the use of adhesives at least at a majority of the fused bonded portions. If desired, a small amount of adhesive may be used, e.g., to tack and/or hold the various parts in place with respect to one another, prior to the fuse bonding step. In such a method, the adhesive will preferably be provided at less than 10% of the overlapping area between the support member 150, 160 and the mesh material. While two support members 150 and 160 are shown in this illustrated example, any desired number of support members may be incorporated into a glove structure without departing from this invention, including one support member (see FIG. 5). In other alternative example constructions according to this invention, at least one of the support member(s) 150, 160 may be engaged with the rear member 120 and/or to one another via adhesives or cements.

The mesh material of the rear member 120 and the material of the support members 150 and 160 may be selected so that these materials fuse bond to one another without the need for an adhesive or cement between the layers (although, as noted above, some adhesive or cement may be used to maintain relative positioning of the parts before the fuse bonding step takes place). As some more specific examples, the support members 150 and/or 160 may be thermoplastic polyurethane film materials (e.g., 0.05 to 0.25 mm thick, and in some examples 0.1 mm thick), e.g., such as TPU film and hot melt film products commercially available from Ding Zing Chemical Product Company, Ltd., of Kaohsiung, Taiwan. Optionally, the mesh material of the rear member 120, at least at locations underlying the support members 150, 160, may be formed from a material that will fuse bond with the TPU or other hot melt film products of the support member(s) 150 and/or 160, such as a TPU material or another fabric mesh material (optionally formed from a material coated or impregnated with a TPU or other material compatible for this fuse bonding process, and in some examples, a mesh material about 0.4 mm thick). Heat and pressure will result in the materials 120, 150, and 160 partially melting together and engaging with one another (e.g., the film support members 150, 160 melt into the mesh 120).

In at least some example glove structures according to this invention, the material of at least one of the support members 150 and/or 160 (and preferably both or all of the support members) may be less stretchable than the mesh material of the rear member 120 at the location to which it is fused. As some more specific examples, the material of the support member(s) may have less than 50% of the stretchability of the underlying mesh material of the rear member 120 at the location where it is fused, and in some examples, less than 40% of the stretchability or even less than 30% of the stretchability.

Various designs or arrangements of the support member(s) 150 and/or 160 (or more) are possible without departing from this invention. In some example structures 100, as shown in FIGS. 1B through 1D, at least one of the support members 150 and/or 160 will extend from one side of the rear member 120 to the other side of the rear member 120 (and optionally from one extreme side edge of the rear member 120 to the other extreme side edge of the rear member 120) in at least one continuous, unbroken path. In the example construction shown in FIGS. 1B through 1D, both support members 150 and 160 extend from one side (e.g., one extreme side edge) of the rear member 120, across the rear main body portion 120*a*, to the opposite side (e.g., the opposite extreme side edge) of the rear member 120.

Also, when multiple support members are present, the support members may at least partially overlap one another. For example, as shown in FIGS. 1B and 1D, in this illustrated example, one of the support members 160 overlaps the other support member 150 at an area proximate to a junction between the rear main body portion 120*a* and the outside-most rear finger portion 122*d* of the rear body member 120. This overlapping construction provides less stretchability, a more stable fit, and greater support at this outside edge location, which location experiences a substantial amount of pressure or force during a swinging action (e.g., a golf swing).

Methods of making golf glove structures in accordance with at least some examples of this invention will be described in more detail below. The fuse bonding portions of this procedure may follow the procedure as generally described, for example, in U.S. Published Patent Appln. Nos. 2011/0088282 and 2011/0088285, which applications are entirely incorporated herein by reference.

In this example procedure, first, a front member 102 of the glove 100 may be cut out, e.g., from a natural or synthetic leather material. While it may be made from multiple pieces that are joined together, in this illustrated example glove structure 100, the front member 102, including the palm covering portion 102*a* and the plurality of finger front portions 104 (optionally four finger front portions 104*a* through 104*d*) may be provided as a single piece of leather material. Optionally, the front portion 108*a* of the thumb element 108 and/or at least some of the gusset members 104*a* through 140*f* (if any) may be cut from this same material (e.g., as one or more separate parts). Cutting may be accomplished in any desired manner without departing from this invention, including using die-cutting techniques, laser cutting techniques, manual cutting techniques, etc.

Similarly, a rear member 120 of the glove 100 may be cut out, e.g., from a mesh material. While it may be made from multiple pieces that are joined together, in this illustrated example glove structure 100, the rear member 120, including the rear main body portion 120*a* and the plurality of finger rear portions 122 (optionally four finger rear portions 122*a* through 122*d*) may be provided as a single piece of mesh material. Optionally, the rear portion 108*b* of the thumb element 108 and/or at least some of the gusset members 104*a* through 104*f* (if any) may be cut from this same mesh material (e.g., as a separate part). Cutting may be accomplished in any desired manner without departing from this invention, including using die-cutting techniques, laser cutting techniques, manual cutting techniques, etc.

Next, the support member(s) 150, 160 may be cut out from a desired support material supply, such as a TPU film or hot melt film material as described above. When multiple support member(s) are present, they may be constructed from the same or different support materials without departing from this invention, and they may have the same or different stretchability properties. Cutting may be accomplished in any desired manner without departing from this invention, including using die-cutting techniques, laser cutting techniques, manual cutting techniques, etc.

Materials for the other parts, such as the closure system 130, the edge piping 170, and the elastic 126, 172 may be produced or obtained from any desired source, such as cut out from larger pieces of appropriate source materials.

The patterns for the rear member 120 and the support member(s) 150, 160 may include darts, tabs, or flaps that extend beyond the edges of the members, and these darts, tabs, or flaps may include through holes defined in them. The rear member 120 may be mounted flat on an assembly jig by placing the holes in the tabs over pins provided in the assembly jig. The support member(s) 150, 160 also may be mounted flat on the assembly jig overlaying the rear member 120, e.g., by placing the holes in their tabs over pins provided in the assembly jig. If desired, the tabs on rear member 120 and/or support members 150, 160 that include the jig mounting holes may be cut off before final glove assembly and/or hidden within the interior chamber of the finally assembled glove structure 100. Alternatively, if desired, at least some of the through holes of the rear member 120 and/or the support member(s) 150, 160 may be provided in locations of these components other than on tabs. If necessary or desired, the support member(s) 150, 160 may be "tacked" to the rear member 120, e.g., by one or more small areas of adhesives, by a few stitches, by mechanical connectors, or the like. Preferably, this type of tacking, if used, will be provided over less than 10% of the surface area to be fused.

Once the assembly jig is fully loaded with at least some of the desired parts for the rear of the glove 100 (e.g., including rear member 120, the desired support member(s) 150, 160), the assembly jig may be placed in a fusing assembly or chamber to allow the parts to be fuse bonded together. As an example, the assembly jig may be placed between heated platens and then the layers on the assembly jig may be pressed together. Sufficient heat and pressure then is applied to the layers to at least partially melt the TPU or hot melt material of the support member(s) 150, 160 and fuse bond these support member(s) 150, 160 to the mesh material of the rear member 120, thereby forming a composite rear member (e.g., that includes the mesh material of the rear member 120 and any desired support members 150, 160 as a single composite part). Similarly, any desired support members may be applied to the thumb element 108 and/or the front member 102 in similar fuse bonding steps (in the same or a different fuse bonding process).

Fuse bonding using procedures and materials of these types is described in more detail, for example, in U.S. Published Patent Appln. Nos. 2011/0088282 and 2011/0088285, as mentioned above. If desired, the use of a jig can be omitted, and the hot pressing step can take place on the materials in an unsecured condition or secured in another manner.

While described above as taking place in a single step, if desired, when multiple support members are present, the support members may be engaged with the rear member 120 and/or with one another (e.g., at an overlapping area) in multiple separate steps of applying heat and pressure. Also, rather than applying heat, fuse bonding may take place by exposing the layers to high frequency radiation, radio frequency radiation, laser radiation, or in other manners that are known and used in the fuse bonding art.

Once the various components of the glove 100 are produced and the composite rear member/support member(s) is produced, the various parts can be engaged together. While these parts can be engaged together in any desired order, the following briefly describes one manner of assembling the various glove parts:

(a) the finger front portions 104*a* through 104*d* may be engaged with the gusset member(s) 140*a* through 140*f*, e.g., by sewing or stitching (as noted above, this composite part may be considered the front member, as that term is used herein);

(b) the thumb front portion 108*a* may be engaged with the thumb rear portion 108*b*, e.g., by sewing or stitching (this composite part may be considered the thumb element 108);

(c) the composite thumb element 108 may be engaged with the front member 102, e.g., by sewing or stitching;

(d) an elastic strap 172 and edge piping 170 may be engaged with the flap 132, e.g., by sewing or stitching;

(e) the flap member 132 (including a portion 134*a* of the hook-and-loop fastener 134) may be engaged with the rear member 120 at the outside edge of the slot 128 for receiving the hand, e.g., by sewing or stitching;

(f) another portion 134*b* of the hook-and-loop fastener 134 may be engaged with the rear member 120 on the opposite side of the slot 128 for receiving the hand, e.g., by sewing or stitching;

(g) the composite rear member 120 (including the support element(s) 150, 160 fuse bonded therewith) and the elastic strap 172 may be engaged with the front member 102 (including any present gussets 140*a* through 1400, e.g., by sewing or stitching;

(h) one or more elastic bands 116, 126 may be engaged around the wrist areas 112 and 124 of the front member 102 and rear member 120, e.g., by sewing or stitching; and (i) edge piping 170 may be engaged with the front member 102 and the rear member 120 around slot 128 and the opening for receiving the hand, e.g., by sewing or stitching.

The elastic strap 172 allows the closure system 130 to be pulled tightly around the wearer's hand. Additional steps may be included in this procedure, additional parts may be included in the glove structure 100, various steps may be combined, certain steps may be omitted, and/or the order of various steps may be changed without departing from this invention.

Many variations in the glove structure and the various parts thereof are possible without departing from this invention.

Figure 2:
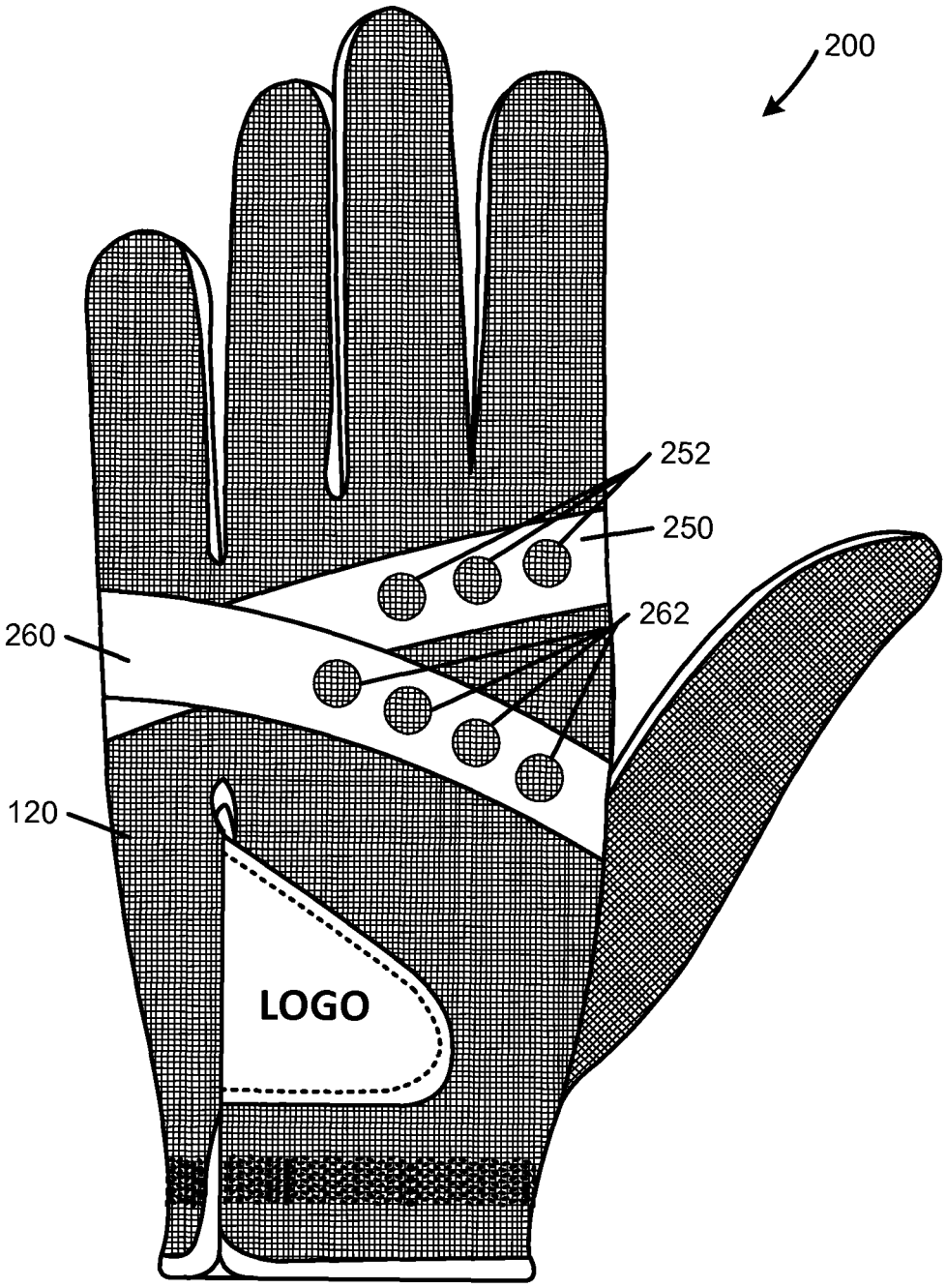
FIG. 2 illustrates a rear view of another example glove structure in accordance with this invention.

For example, FIG. 2 illustrates an example glove structure 200 similar to the structure 100 shown in FIGS. 1A through 1D, but the support members 250 and 260 of glove structure 200 are somewhat different. More specifically, as shown in FIG. 2, while the support members 250 and 260 still generally extend across the entire rear member 120 (e.g., from one side to the other, and optionally, from one edge to the other), support members 250 and 260 of this example structure 200 have openings 252, 262 defined in them. The mesh material of the rear member 120 is exposed through these openings 252, 262. Any desired numbers of openings 252, 262, opening shapes, and the like, may be provided without departing from this invention. Notably, while the openings 252, 262 are provided, each of the support members 250, 260 in this example structure 200 still defines at least one continuous, unbroken path from one edge of the support member 250, 260 to the other, and optionally from one side or extreme edge of the rear member 120 to the other. The size(s) and location(s) of the openings 252, 262 may be controlled and selected so as to provide the desired level of support and/or stretch resistance and/or to provide an overall desired aesthetic appearance to the glove 200. For example, if desired, an opening could be left in one or more of the support members 250, 260 in the shape of a corporate/brand name or in the shape of a logo.

Figure 3:
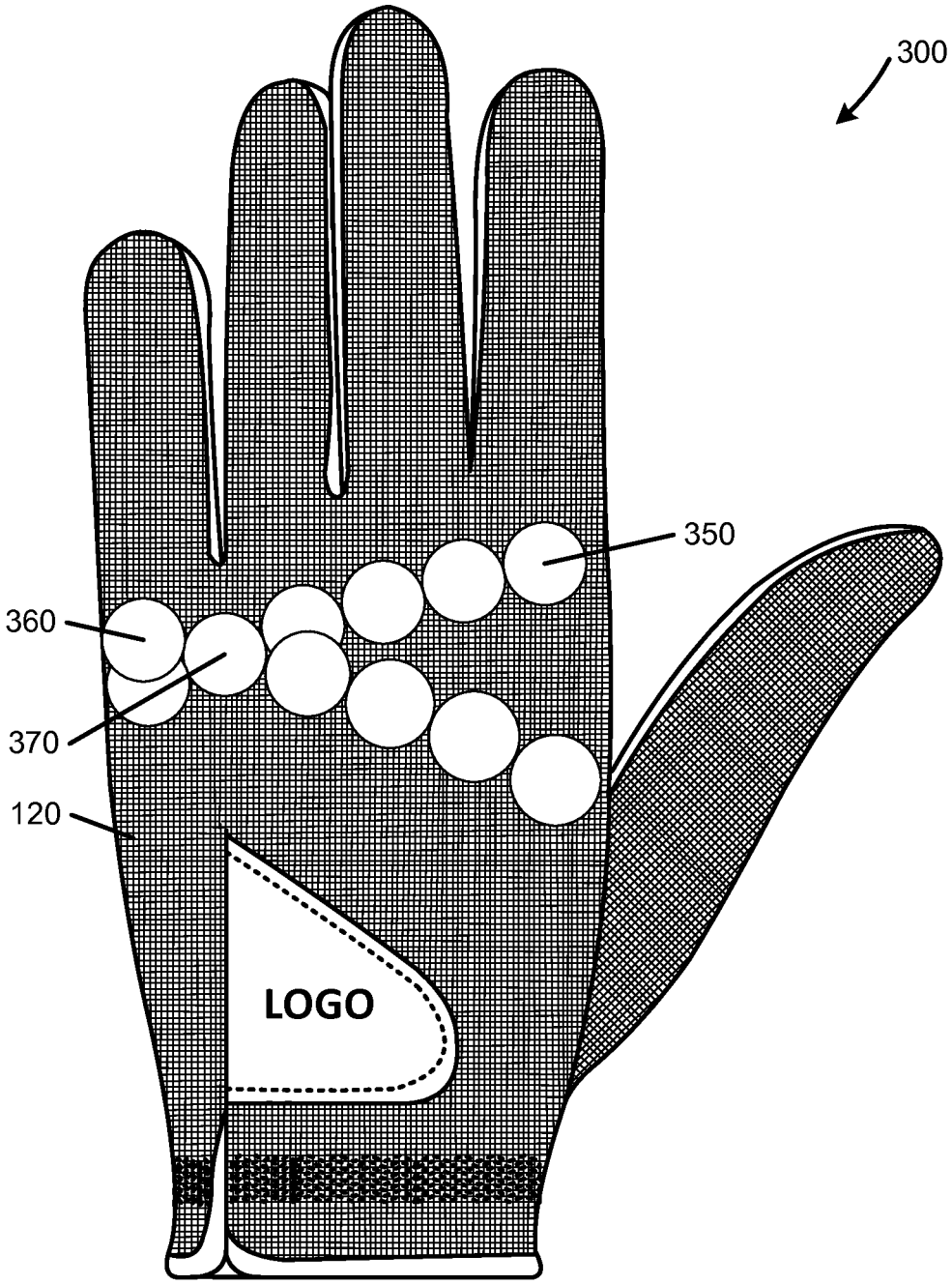
FIG. 3 illustrates a rear view of yet another example glove structure in accordance with this invention.

As another example, FIG. 3 shows a glove structure 300 in which the support members 350, 360 are not in the form of generally rectangular stripes, as shown in FIGS. 1A through 2. Rather, in this illustrated example, the support members 350, 360 are in the form of abutting or overlapping circles (although other shapes or combinations of shapes may be provided without departing from this invention). Any desired numbers of individual circles or other shapes, and the like, may be provided without departing from this invention. Notably, the overlapping support circles (or other shapes) of the support members 350, 360 in this example structure 300 still define at least one continuous, unbroken path from one side of the support member 350, 360 to the other, and optionally from one side or extreme edge of the rear member 120 to the other. The size(s), location(s), and/or overlapping extent of the abutting or overlapping circles or other shapes may be selected and arranged so as to provide the desired level of support and/or stretch resistance and/or to provide an overall desired aesthetic appearance to the glove 300. Also, while shown as overlapping and abutting, if desired, gaps may be provided between at least some of the adjacent circles or other shapes in at least some example structures according to this invention (i.e., the support member path across the rear member 120 may have one or more breaks in it, if desired). The individual circle or other elements of the support members 350, 360 may be the same or different without departing from this invention (e.g., different materials, different thicknesses, different stretch resistances, different sizes, etc.).

Notably, in this example arrangement 300, support member path 350 and support member path 360 share one common circle element 370. While it may be a single component, if desired, this circle element 370 may be made from a thicker TPU or hot melt film material and/or it may be made from two layers of TPU or hot melt film material without departing from this invention.

Figure 4:
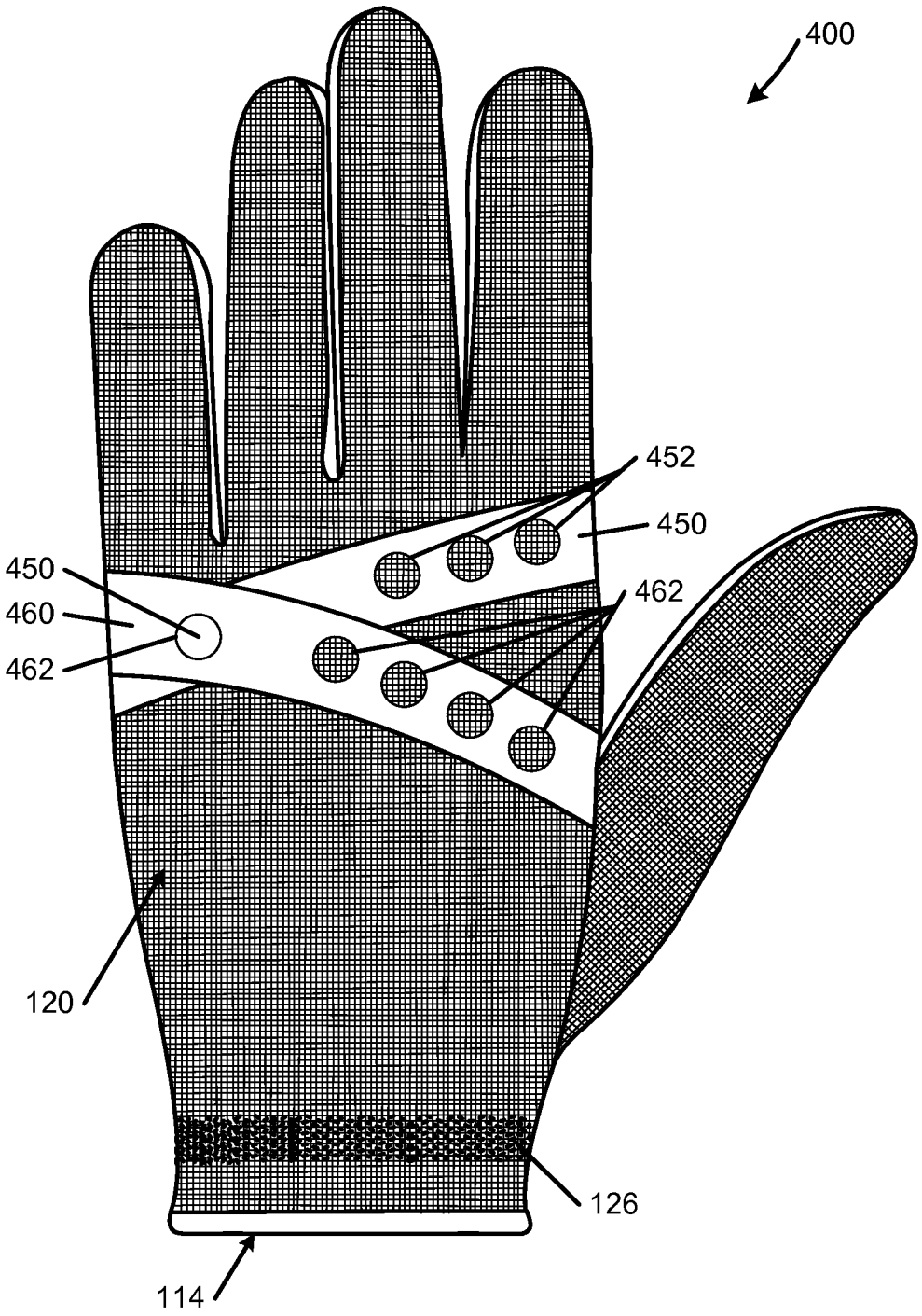
FIG. 4 illustrates a rear view of still another example glove structure in accordance with this invention.

FIG. 4 shows another example glove structure 400 in accordance with this invention. This glove structure 400 is similar to the glove structure 200 shown in FIG. 2, except in the structure 400 of FIG. 4, the glove closure system is omitted. Such closure systems may be omitted, for example, if the mesh material of the rear member 120 and/or the elastic component(s) 116, 126 around the wrist opening 114 are sufficiently stretchable to enable the wearer to insert his/her hand without the need for a wider opening (e.g., slot 128). The example structure 400 of FIG. 4 further shows that the upper support member 460 may include one or more openings 462 through which the lower support member 450 is exposed. As another possible alternative, one or more openings 462 through the upper support member 460 may be located at appropriate locations such that both the lower support member 450 and the mesh material of the rear member 120 are exposed through a single opening 462. As described above with respect to FIG. 2, the size(s) and location(s) of the openings 452, 462 may be selected and controlled so as to provide the desired level of support and/or stretch resistance and/or to provide an overall desired aesthetic appearance to the glove 400.

Figure 5:
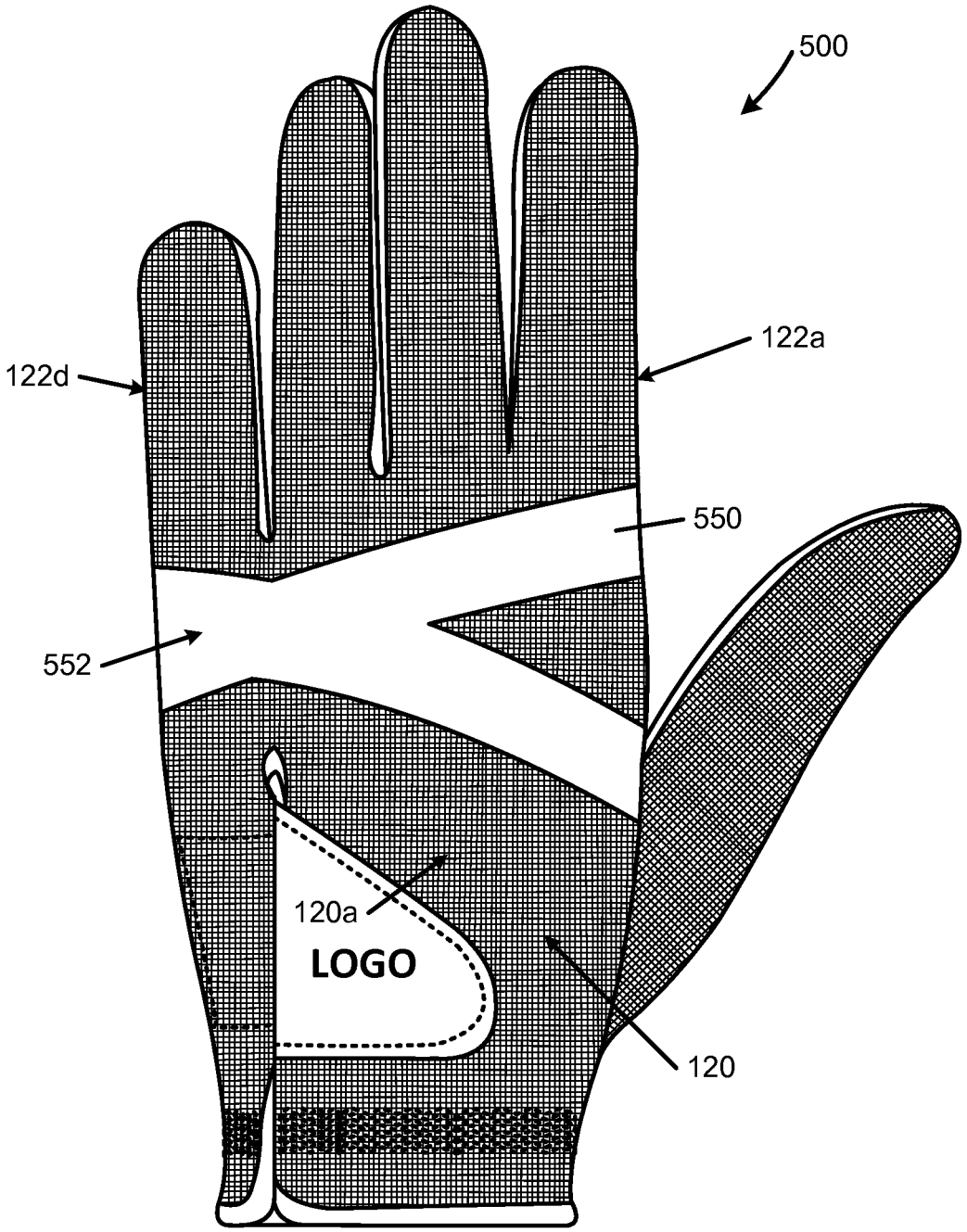
FIG. 5 illustrates another rear view of an example glove structure in accordance with this invention.

FIG. 5 shows a rear view of an example glove structure 500 that includes a single support member 550, as opposed to the two or more support members described in the examples above. As shown, the single support member 550 may have any desired shape so as to provide support and excessive stretch resistance at any desired areas of the glove structure 500. In this illustrated example, the single support member 550 extends: (a) generally along the knuckle line from one side of the rear member 120 to the other and (b) generally from a base area 552 where the rear main body portion 120*a* meets the rear outside-most finger portion 122*d* to an area proximate to a side of the rear member 120 opposite the outside-most rear finger portion 122*d* (e.g., on the index finger 122*a* side). If desired, certain areas of this single support member 550 may be thicker, doped with another material, or otherwise modified to provide additional support in various selected areas, such as at the area 552 where the rear main body portion 120*a* meets the rear outside-most finger portion 122*d* (e.g., the area where the individual support members 150 and 160 overlapped in the structure 100 of FIGS. 1A through 1D).

In the various example structures described above with respect to FIGS. 1A through 5, the fronts of every finger and the front of the thumb were made from the leather material and the rears of every finger and the rear of the thumb were made from the mesh material. This is not a requirement. For example, if desired, the entire thumb and/or index finger (e.g., thumb front 108*a* and rear 108*b* and/or index finger front 104*a*, rear 122*a*, and gusset 140*a*) may be made from the leather material. As another example, if desired, at least the upper portion of the rear index finger 122*a* (e.g., above the first major joint) may be made from the leather material (so that when gripping a golf club, the overlapping fingers from the ungloved hand will mainly touch leather rather than mesh). Other variations in the presence of the mesh and leather materials are possible without departing from this invention.

Also, in the illustrated examples of this invention, the support members 150, 160, 250, 260, 350, 360, 450, 460, and 550 engage only the rear member 120. This also is not a requirement. Rather, if desired, the support members 150, 160, 250, 260, 350, 360, 450, 460, and 550 may extend around the sides of the glove and engage/at least partially overlap the front member 102 without departing from this invention. Thus, the support members 150, 160, 250, 260, 350, 360, 450, 460, and 550 need not terminate at the extreme edges of the rear member 120. The support members 150, 160, 250, 260, 350, 360, 450, 460, and 550 also need not extend all of the way to the extreme edges of the rear member 120, if desired.

Other options are possible in glove structures in accordance with examples of this invention. For example, when multiple support members are provided on a single glove (e.g., 150, 160; 250, 260; 350, 360; and 450, 460), the support members (or portions thereof) may be of different colors, e.g., to provide desired or interesting aesthetic designs. For example, the colors may be contrasting with one another or with the color of the mesh material of the rear member 120, the front member 102, etc. As additional examples, the colors may correspond to school or team colors for a player or to support a cause (e.g., breast cancer or AIDS awareness). As yet another example, if desired, one or both of the support members may be of colored transparent or translucent materials, e.g., so as to provide interesting color blends at any overlapping areas. A wide variety of colors, color combinations, and/or overlapping patterns may be provided without departing from this invention.

Also, while the specific example structures described herein include a layer of mesh material 120 and one or more layers of support material on top of it, other constructions are possible without departing from this invention. As more specific examples, some gloves or other hand-receiving device structures in accordance with examples of this invention may include a backing layer on the side of the mesh material 120 opposite the support member(s) (at least at some locations on the opposite side of the mesh material 120 from the support member(s)). The backing layer, when present at one or more locations, may be selected to provide any desired properties, such as a comfortable feel, wear resistance, hand protection, warmth (or reduced breathability), further support, further support at selective locations, support for mounting other components, etc.

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A glove, comprising:

a front member including a palm covering portion and four finger front portions extending from the palm covering portion, wherein the four finger front portions include an index front finger portion, an outside-most front finger portion, and two intermediate front finger portions, and wherein the front member is formed from a natural leather or synthetic leather material; and a rear member engaged with the front member for covering a back of a hand, wherein the rear member includes:

a rear main body portion located opposite the palm covering portion, four finger rear portions extending from the rear main body portion and located opposite the four finger front portions, wherein the four finger rear portions include an index rear finger portion, an outside-most rear finger portion, and two intermediate rear finger portions, and wherein the rear main body portion and the four finger rear portions are made from mesh material, a first support member fused to the mesh material of the rear member and extending generally along a knuckle covering portion of the rear member, wherein the first support member is formed from a material that is less stretchable than the mesh material of the rear member to which it is fused, and a second support member fused to the mesh material of the rear member and extending from a base area of the outside-most rear finger portion to an area proximate to a side of the rear member opposite the outside-most rear finger portion, wherein the second support member is formed from a material that is less stretchable than the mesh material of the rear member to which it is fused.

2. A glove according to claim 1, further comprising:

a thumb element engaged at least in part with the front member, wherein an inside portion of the thumb element is formed from a natural leather or synthetic leather material, and wherein an outside portion of the thumb element is formed from mesh material.

3. A glove according to claim 1, further comprising:

a closure system engaged with at least one of the front member and the rear member, wherein the closure system includes a flap engaged with at least one of the front member and the rear member, wherein the flap includes a first portion of a hook-and-loop fastener, and wherein a second portion of the hook-and-loop fastener is engaged with the rear member.

4. A glove according to claim 1, wherein the material of the first support member is a thermoplastic polyurethane material.

5. A glove according to claim 1, wherein the material of the second support member is a thermoplastic polyurethane material.

6. A glove according to claim 1, wherein at least one of the first support member and the second support member has a stretchability of less than 50% of a stretchability of the mesh material of the rear main body portion to which it is fused.

7. A glove according to claim 1, wherein:

an outside of the index front finger portion is engaged with an outside of the index rear finger portion, an inside of the index front finger portion is engaged with an inside of the index rear finger portion via a first gusset member, a first side of a first intermediate front finger portion is engaged with a first side of a first intermediate rear finger portion by a second gusset member, a second side of the first intermediate front finger portion is engaged with a second side of the first intermediate rear finger portion by a third gusset member, a first side of a second intermediate front finger portion is engaged with a first side of a second intermediate rear finger portion by a fourth gusset member, a second side of the second intermediate front finger portion is engaged with a second side of the second intermediate rear finger portion by a fifth gusset member, an inside of the outside-most front finger portion is engaged with an inside of the outside-most rear finger portion by a sixth gusset member, and an outside of the outside-most front finger portion is engaged with an outside of the outside-most rear finger portion.

8. A glove according to claim 1, wherein an outside of the index front finger portion is directly engaged with an outside of the index rear finger portion and an outside of the outside-most front finger portion is directly engaged with an outside of the outside-most rear finger portion.

9. A glove according to claim 1, wherein the second support member forms at least one unbroken path from a first edge of the rear member to an opposite second edge of the rear member.

10. A glove according to claim 1, wherein the first support member forms at least one unbroken path from a first edge of the rear member to an opposite second edge of the rear member.

11. A glove according to claim 1, wherein the first support member and the second support member partially overlap.

12. A glove according to claim 1, wherein the first support member and the second support member partially overlap at an area proximate to a junction between the rear main body portion and the outside-most rear finger portion.

13. A glove, comprising:

a front member including a palm covering portion and a plurality of finger front portions extending from the palm covering portion; and a rear member engaged with the front member for covering a back of a hand, wherein the rear member includes:

a rear main body portion located opposite the palm covering portion, a plurality of finger rear portions extending from the rear main body portion, wherein the rear main body portion and the plurality of finger rear portions are made from mesh material, a first support member fused to the mesh material of the rear member and extending from a first side of the rear member to an opposite second side of the rear member, wherein the first support member is formed from a material that is less stretchable than the mesh material of the rear member to which it is fused, and a second support member fused to the mesh material of the rear member and extending from the first side of the rear member to the opposite second side of the rear member, wherein the second support member is formed from a material that is less stretchable than the mesh material of the rear member to which it is fused.

14. A glove according to claim 13, wherein the material of the first support member is a thermoplastic polyurethane material.

15. A glove according to claim 13, wherein the material of the second support member is a thermoplastic polyurethane material.

16. A glove according to claim 13, wherein the second support member forms at least one unbroken path from a first edge of the rear member to an opposite second edge of the rear member.

17. A glove according to claim 13, wherein the first support member forms at least one unbroken path from a first edge of the rear member to an opposite second edge of the rear member.

18. A glove according to claim 13, wherein the first support member and the second support member partially overlap.

19. A glove according to claim 13, wherein the first support member and the second support member partially overlap at an area proximate to a junction between the rear main body portion and an outside-most of the finger rear portions.

20. A glove, consisting essentially of:

a front member including a palm covering portion and a plurality of finger front portions extending from the palm covering portion;

a rear member engaged with the front member for covering a back of a hand, wherein the rear member includes:

a rear main body portion located opposite the palm covering portion, a plurality of finger rear portions extending from the rear main body portion, wherein the rear main body portion and the plurality of the finger rear portions are made from mesh material, a first support member fused to the mesh material of the rear member and extending from a first side of the rear member to an opposite second side of the rear member, wherein the first support member is formed from a material that is less stretchable than the mesh material of the rear member to which it is fused, and a second support member fused to the mesh material of the rear member and extending from the first side of the rear member to the opposite second side of the rear member, wherein the second support member is formed from a material that is less stretchable than the mesh material of the rear member; and a thumb element engaged at least in part with the front member to which it is fused.

21. A glove, consisting essentially of:

a front member including a palm covering portion and a plurality of finger front portions extending from the palm covering portion;

a rear member engaged with the front member for covering a back of a hand, wherein the rear member includes:

a rear main body portion located opposite the palm covering portion, a plurality of finger rear portions extending from the rear main body portion, wherein the rear main body portion and the plurality of the finger rear portions are made from mesh material, a first support member fused to the mesh material of the rear member and extending from a first side of the rear member to an opposite second side of the rear member, wherein the first support member is formed from a material that is less stretchable than the mesh material of the rear member to which it is fused, and a second support member fused to the mesh material of the rear member and extending from the first side of the rear member to the opposite second side of the rear member, wherein the second support member is formed from a material that is less stretchable than the mesh material of the rear member to which it is fused;

a thumb element engaged at least in part with the front member; and a closure system engaged with at least one of the front member and the rear member.

22. A glove, consisting essentially of:

a front member including a palm covering portion and a plurality of finger front portions extending from the palm covering portion;

a rear member engaged with the front member for covering a back of a hand, wherein the rear member includes:

a rear main body portion located opposite the palm covering portion, a plurality of finger rear portions extending from the rear main body portion, wherein the rear main body portion and the plurality of the finger rear portions are made from mesh material, a first support member fused to the mesh material of the rear member and extending from a first side of the rear member to an opposite second side of the rear member, wherein the first support member is formed from a material that is less stretchable than the mesh material of the rear member to which it is fused, and a second support member fused to the mesh material of the rear member and extending from the first side of the rear member to the opposite second side of the rear member, wherein the second support member is formed from a material that is less stretchable than the mesh material of the rear member to which it is fused;

a thumb element engaged at least in part with the front member; and at least one elastic component engaged with at least one of the front member and the rear member extending along a wrist opening area.

23. A glove, comprising:

a front member including a palm covering portion and a plurality of finger front portions extending from the palm covering portion; and a rear member engaged with the front member for covering a back of a hand, wherein the rear member includes:

a rear main body portion located opposite the palm covering portion, a plurality of finger rear portions extending from the rear main body portion, wherein the rear main body portion and the plurality of finger rear portions are made from mesh material, and a first support member fused to the mesh material of the rear member and extending from a first side of the rear member to an opposite second side of the rear member, wherein the first support member is formed from a material that is less stretchable than the mesh material of the rear member to which it is fused.

24. A hand-receiving device, comprising:

a front member for covering at least a portion of a palm; and a rear member engaged with the front member, wherein the rear member includes:

a rear main body portion located along at least some of a knuckle covering portion of the rear member and made from a mesh material, a support member fused to the mesh material of the rear main body portion, wherein the support member is formed from a material that is less stretchable than the mesh material of the rear main body portion to which it is fused, and wherein the support member includes a first portion that extends along the knuckle covering portion of the rear member and a second portion extending from an outside-most knuckle covering portion of the rear member toward an area proximate to a side of the rear member opposite the outside-most knuckle covering portion of the rear member.

25. A hand-receiving device according to claim 24, wherein the first portion and the second portion of the support member are made from separate pieces of support material fused to one another and to the mesh material.

* * * * *